US010934749B2

(12) United States Patent
Braz

(10) Patent No.: US 10,934,749 B2
(45) Date of Patent: Mar. 2, 2021

(54) SLIDING BOLT LATCH AND USE THEREOF

(71) Applicant: Alik Alexander Braz, Ranch Mikhmoret (IL)

(72) Inventor: Alik Alexander Braz, Ranch Mikhmoret (IL)

( * ) Notice: Subject to any disclaimer, the term of this patent is extended or adjusted under 35 U.S.C. 154(b) by 134 days.

(21) Appl. No.: 15/328,590

(22) PCT Filed: Jan. 18, 2016

(86) PCT No.: PCT/IB2016/050232
§ 371 (c)(1),
(2) Date: Jan. 24, 2017

(87) PCT Pub. No.: WO2016/113722
PCT Pub. Date: Jul. 21, 2016

(65) Prior Publication Data

US 2017/0356222 A1 Dec. 14, 2017

Related U.S. Application Data

(60) Provisional application No. 62/104,770, filed on Jan. 18, 2015.

(51) Int. Cl.

| | |
|---|---|
| ***E05B 15/04*** | (2006.01) |
| ***E05C 1/00*** | (2006.01) |
| ***E05C 1/04*** | (2006.01) |
| ***E05C 5/02*** | (2006.01) |

(52) U.S. Cl.
CPC ..... *E05C 1/004* (2013.01); *E05B 15/04* (2013.01); *E05C 1/04* (2013.01); *E05C 5/02* (2013.01); *E05B 2015/0413* (2013.01)

(58) Field of Classification Search
CPC ... E05C 1/004; E05C 1/04; E05C 5/02; E05B 15/04; E05B 2015/0413
See application file for complete search history.

(56) References Cited

U.S. PATENT DOCUMENTS

| | | | | |
|---|---|---|---|---|
| 266,601 A | | 10/1882 | Blayney | |
| 1,315,266 A | | 9/1919 | Weiland | |
| 1,333,974 A | | 3/1920 | Gordon | |
| 1,602,264 A | * | 10/1926 | Hutchison | E05C 1/04 292/60 |
| 1,675,033 A | | 6/1928 | Lefkovitz et al. | |

(Continued)

FOREIGN PATENT DOCUMENTS

| | | |
|---|---|---|
| CN | 2063555 U | 10/1990 |
| CN | 202882559 U | 4/2013 |

(Continued)

*Primary Examiner* — Kristina R Fulton
*Assistant Examiner* — Thomas L Neubauer
(74) *Attorney, Agent, or Firm* — Dorsey & Whitney LLP

(57) ABSTRACT

A sliding bolt latch as disclosed herein is convenient to use and more reliable than counterpart door locking mechanisms of the prior art. A user may open and close a door with only one hand, but the present mechanism requires both a rotational movement and a translational movement of elements against a biasing force. Such requirement makes opening doors much more difficult for livestock confined to spaces by the closed doors. Also, the biasing of elements into the locking state makes embodiments of the invention less likely to unlock inadvertently in the presence of ambient vibrations.

22 Claims, 6 Drawing Sheets

(56) References Cited

U.S. PATENT DOCUMENTS

| | | | | |
|---|---|---|---|---|
| 2,253,496 | A | 8/1941 | Cordrey et al. | |
| 2,714,814 | A | 8/1955 | Shaffer | |
| 2,845,789 | A | 8/1958 | Kistner | |
| 3,958,820 | A | 5/1976 | Teeple | |
| 4,580,824 | A | 4/1986 | Asp | |
| 5,032,045 | A | 7/1991 | Calco | |
| 5,618,066 | A * | 4/1997 | Fu-Hsiang | E05B 47/0009 292/62 |
| 5,746,455 | A | 5/1998 | Takimoto | |
| 8,250,811 | B2 * | 8/2012 | Zijlstra | E05C 1/10 292/57 |
| 2006/0186673 | A1 * | 8/2006 | Wong | E05B 47/026 292/175 |
| 2014/0175811 | A1 | 6/2014 | Fu | |

FOREIGN PATENT DOCUMENTS

| | | | |
|---|---|---|---|
| GB | 183594 | A | 7/1922 |
| GB | 2328473 | A | 2/1999 |
| WO | WO 2004/031518 | A1 | 4/2004 |

* cited by examiner

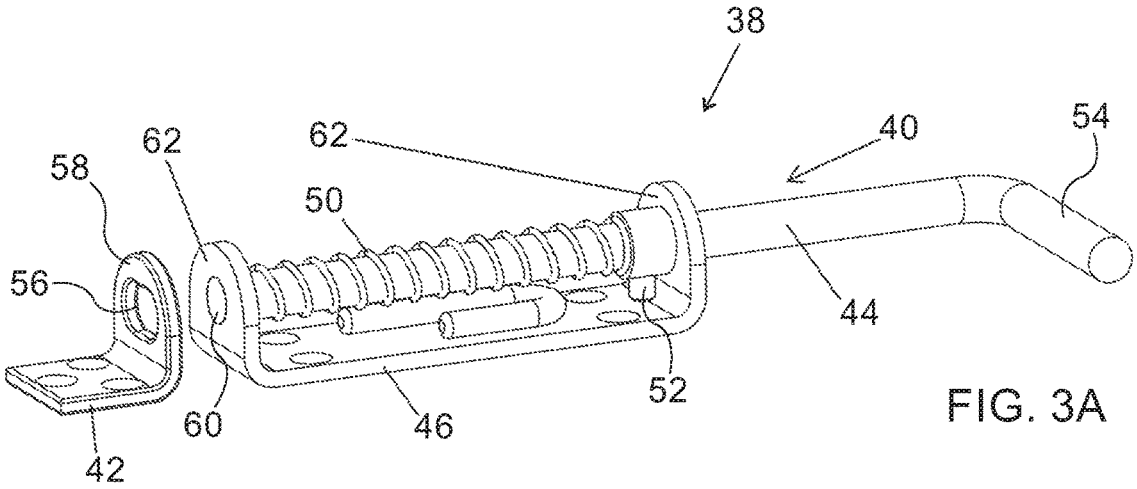
FIG. 3A
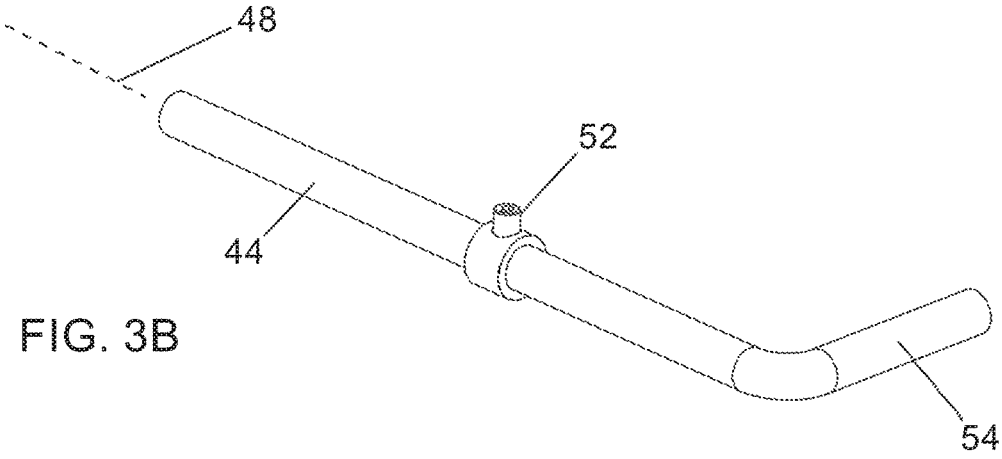
FIG. 3B
FIG. 3C
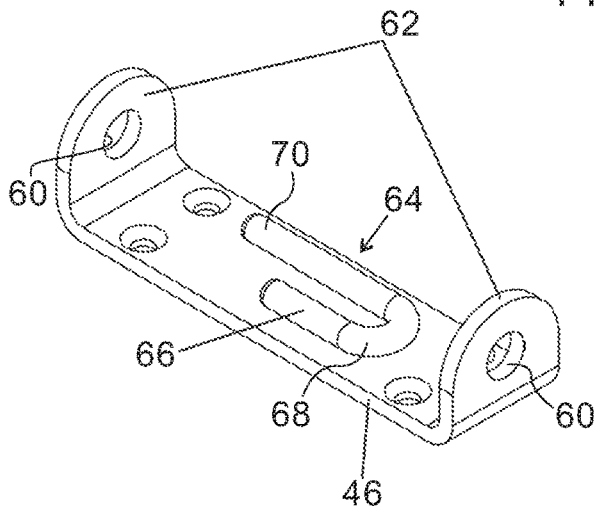
FIG. 3D
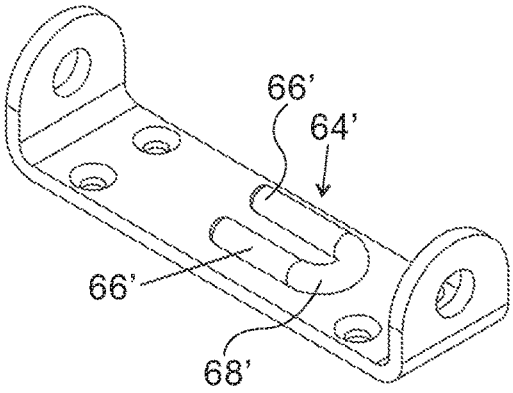

SLIDING BOLT LATCH AND USE THEREOF

RELATED APPLICATION

This application claims benefit under 35 U.S.C. § 119(e) of the Jan. 18, 2015 filing of U.S. Provisional Application No. 62/104,770, which is hereby incorporated by reference in its entirety.

BACKGROUND

One known mechanism to lock a door uses a bolt slidably mounted on the door. This mechanism 10 is described with respect to FIGS. 1A-1D. To lock the door (not illustrated for clarity), the bolt 12 slides toward the door's frame (also not shown) and partially penetrates a hole or instead an appropriately-positioned bounded area 13 of a brace 14 mounted on the door frame. This mechanism 10 may also be used to lock a window in an analogous fashion. The mechanism 10 includes a pin 16 extending transversely from the bolt 12 so that a barrier 18 to movement of the pin 16 also prevents movement of the bolt 12, and under general use circumstances the mechanism 10 effectively keeps the door locked or unlocked, depending on the axial position of the pin 16.

FIG. 1A shows the locking mechanism 10 in the locked position. The translational movement of the pin 16 is constrained by the barrier 18, so the translational movement of the bolt 12 is constrained, also, keeping the door upon which the locking mechanism 10 is mounted locked.

To unlock the door, the pin 16 is rotated ninety degrees in the direction of the arrow as shown in FIG. 1B and then slid in the direction of the arrow as shown in FIG. 1C away from the brace 14 mounted on the door frame. The bolt 12 is no longer bounded by the brace 14, so the door on which the locking mechanism 10 is mounted may swing open. In other words, the brace 14 constrained translational movement of the bolt 12 to its axis when the bolt 12 was in the region of axial positions shown in FIGS. 1A and 1B, but the brace 14 allows translational movement of the bolt 12 in addition to its axial movement when the bolt 12 is in the region of axial positions shown in FIGS. 1C and 1D, the additional translational movement resulting from the door swinging open and moving the locking mechanism 10, except for the brace 14, along an arc. As further illustrated in FIG. 1D, rotating the pin 16 back ninety degrees keeps the mechanism 10 in the unlocked position, as the barrier 18 prevents translational movement of the pin 16.

Although the mechanism 10 has proven effective for many uses, situations arise where such mechanism 10 does not perform as well as desired. For example, the conventional mechanism 10 is not as effective for locking a half door (sometimes called a "Dutch door") of a stable for horses, because the horses often succeed at opening doors by extending their heads outside their chambers and then lowering their heads to engage the locks with their mouths. The horses are able to rotate the bolts and then slide them to unlock the doors. Another disadvantage of the locking mechanism 10 is that it opens by itself sometimes in the environment of ambient vibrations, for example, if the locking mechanism 10 is mounted on a machine or if it is close to a machine.

Illustrated in FIG. 2 is another conventional locking mechanism 20. Similarly to the locking mechanism 10 in FIGS. 1A-1D, the locking mechanism 20 comprises a base 22, a bolt 24, a brace 26, and a pin 28. The base 22 supports the bolt 24 and the pin 28 while allowing both the bolt 24 and the pin 28 to rotate and to slide translationally. An end segment 30 at one end of the bolt 24 extends perpendicularly to the main body 32 of the bolt 24. The other end of the bolt 24 has a cap 34 mounted thereto. When a door upon which the locking mechanism 20 is mounted is locked, the bolt 24 cannot slide away from the brace 26 due to the brace 26 blocking the end segment 30 of the bolt 24 from translational movement. As with the locking mechanism 10, the door locked with the locking mechanism 20 mounted thereon is unlocked by rotating the bolt 24 approximately ninety degrees. Unlike the locking mechanism 10, though, the locking mechanism 20 has a spring 36 compressed between the cap 34 and the base 22. Accordingly, when the brace 26 no longer prevents translational movement of the bolt 24 due to the angle of the bolt end segment 30, the spring 36 forces the bolt 24 to the unlock position without the user needing to manually slide the bolt 24 to the unlock position.

An advantage of the locking mechanism 20 over the locking mechanism 10 is that the spring 36 biases the end segment 30 of the bolt 24 against the brace 26, which makes ambient vibrations much less likely to cause the mechanism 20 to unlock. Another advantage is that a user, perhaps with his/her hands full when wanting to open the door, needs only to rotate the bolt 24 and to let the spring 36 cause the mechanism 20 to transition to unlock.

However, while the spring 36 causes the locking mechanism 20 to have the advantages discussed above, it also has the disadvantage of making it much easier for livestock to unlock the mechanism 20. Just as a human with his/her hands full can unlock the mechanism 20 more easily, the animal need only grasp the pin 28 and rotate it approximately ninety degrees to escape from its confinement.

Accordingly, the present inventor decided to improve the conventional mechanisms 10 and 20 of FIGS. 1A-1D and 2 in a way requiring minimal additional manufacturing costs while not detracting from the convenience of use.

SUMMARY

Embodiments of the present invention are convenient as in the prior art. A user may open and close a door with only one hand, but the embodiments are more reliable for locking doors for multiple reasons. As detailed below, both rotational and translational movements of the bolt against a biasing force make opening doors much more difficult for livestock. Also, biasing the bolt into the locking state makes embodiments of the invention less likely to fail in the presence of ambient vibrations.

The invention may be embodied as a sliding bolt latch. The sliding bolt latch includes: a slidable and rotatable bolt having an axis; a spring biasing the bolt in the direction of the bolt axis; a projection extending from the bolt; and a base having a barrier that limits sliding and rotating movement of the projection.

The invention may also be embodied as a sliding bolt latch assembly. The sliding bolt latch assembly include: a sliding bolt latch as discussed in the previous paragraph; and a brace for constraining translational movement of the bolt to its axis when the bolt is in one region of axial positions and for allowing translational movement of the bolt in addition to axial movement when the bolt is in another region of axial positions.

The invention may further be embodied as a method of unlocking a latch assembly having a bolt and a spring biasing the bolt to an axial position in which the bolt cannot rotate. The method includes: forcing the bolt to move axially against the spring biasing; rotating the bolt; and permitting the bolt to move axially in the direction of the spring biasing.

Embodiments of the present invention are described in detail below with reference to the accompanying drawings, which are briefly described as follows:

BRIEF DESCRIPTION OF THE DRAWINGS

The invention is described below in the appended claims, which are read in view of the accompanying description including the following drawings, wherein:

FIGS. 3A-3C present a sliding bolt latch assembly in accordance with a first embodiment of the invention;

FIG. 3D presents a modification of the embodiment of FIGS. 3A-3C;

DETAILED DESCRIPTION

Figure 1A:
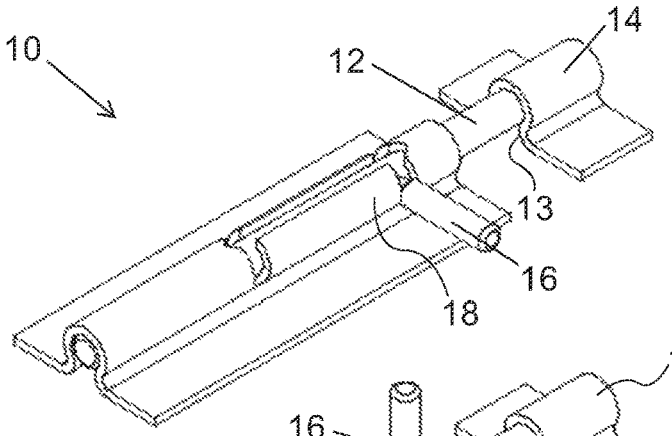
FIG. 1A PRIOR ART
FIGS. 1A-1D present a prior art locking mechanism.
Figure 1B:
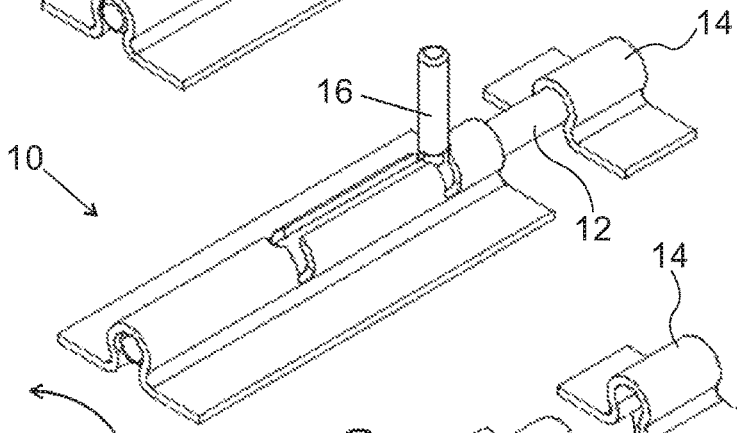
FIG. 1B PRIOR ART
Figure 1C:
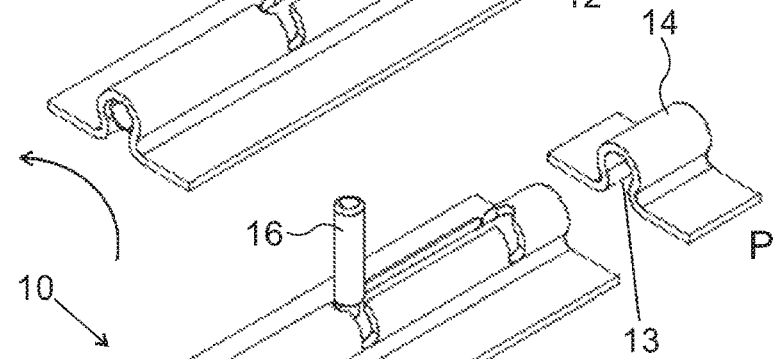
FIG. 1C PRIOR ART
Figure 1D:
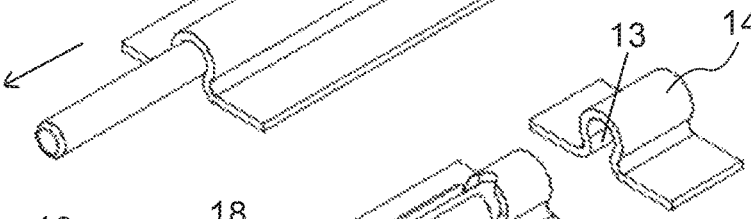
FIG. 1D PRIOR ART
Figure 2:
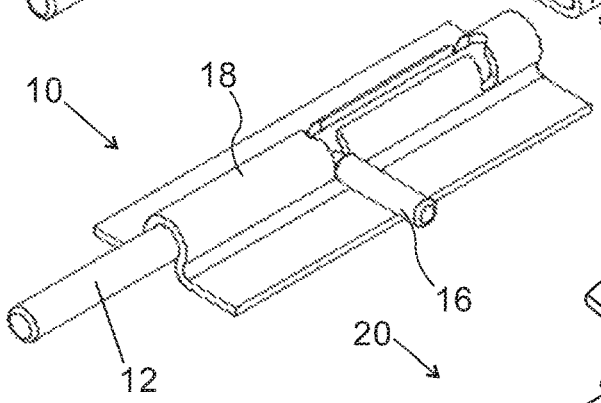
FIG. 2 PRIOR ART
FIG. 2 presents an alternative prior art locking mechanism.
Figure 2:
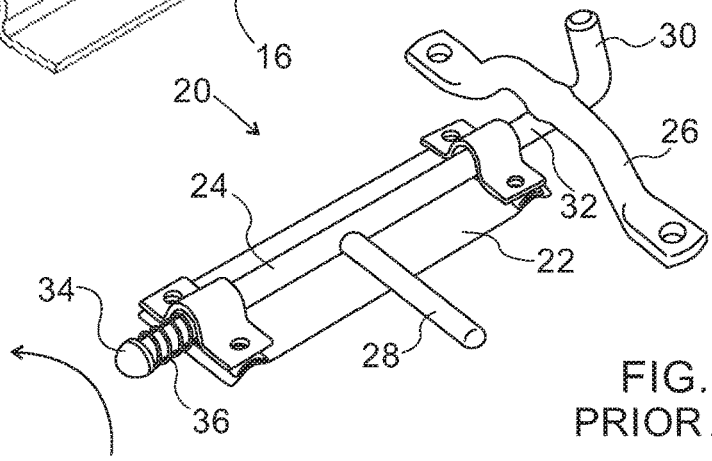
FIG. 2 PRIOR ART

The invention summarized above and defined by the claims below will be better understood by referring to the present detailed description of embodiments of the invention. This description is not intended to limit the scope of claims but instead to provide examples of the invention.

As disclosed herein, the present sliding bolt latch maintains doors, window, etc. in a closed position better than done by the prior art discussed in the preceding section. As a result, livestock is not able to open doors locked with this latch so easily, and ambient vibrations are not likely to cause the latch to transition to the open position.

A first exemplary embodiment of the invention is illustrated in FIGS. 3A-3C. FIG. 3A provides a prospective view of a sliding bolt latch assembly 38 comprising a sliding bolt latch 40 and an associated brace 42. FIGS. 3B and 3C provide unobstructed views of some of the components of the sliding bolt latch 40.

As shown, the sliding bolt latch 40 includes a bolt 44 and a base 46. The bolt 44 is slidable in that it can slide in the direction of its axis 48. The bolt 44 is also rotatable about that axis 48. A coil spring 50 surrounding the bolt 44 biases the bolt 44 along the bolt axis 48 toward the right in FIG. 3A. The bolt 44 has a projection 52 extending perpendicularly therefrom. The bolt 44 also has a handle 54 integral with the bolt 44.

The brace 42 of the sliding bolt latch assembly 38 is intended for placement at one end of the sliding bolt latch 40 (the left end in FIG. 3A). Typically, the brace 42 is mounted as on the door frame surrounding the door upon which the sliding bolt latch 40 is mounted. The brace 42 has a hole 56 functioning as a bolt guide 58 through which the bolt 44 slides. The bolt guide 58 allows rotational movement of the bolt 44 and constrains translational movement to the direction of the bolt axis 48.

The base 46 in this embodiment has two holes 60 forming two integral bolt guides 62 through which the bolt 44 slides and is free to rotate. As with the bolt guide 58 of the brace 42, the bolt guides 62 of the base 46 allow rotational movement of the bolt 44 and constrain translational movement of the bolt 44 to sliding in the direction of the axis 48.

Underneath the bolt 44, the base 46 has a barrier 64 that limits sliding and rotating movements of the projection 52. In the present embodiment, the barrier 64 compromises a shorter straight portion 66, a curved portion 68, and a longer straight portion 70 joined in the stated order to resemble a rod bent into a "J" shape. With such a shape of the barrier 64, the bolt 44 is free to slide axially between a region in which the barrier 64 prevents rotation of the bolt 44 in the both directions and a region in which the barrier 64 prevents rotation of the bolt 44 in only one direction. The reason for this shape is apparent when a method of the using the sliding bolt latch 40 is discussed below with reference to FIGS. 4A-4E.

FIG. 3D illustrates a modification of the embodiment of FIGS. 3A-3C. Elements not illustrated in FIG. 3D are identical to the corresponding elements in FIGS. 3A-3C. In the alternative embodiment of FIG. 3D, a barrier 64' comprises two straight portions 66' each joined to a curved portion 68' to resemble a rod bent into a "U" shape.

The barrier 64' is useful with a sliding bolt latch that is formed so that the projection extending from the bolt can be removed and then reinstalled onto the bolt 180 degrees around the bolt axis from its original position so the sliding bolt latch assembly may be used on door that swings open in the opposite direction. One way to facilitate easy removal and reinstallation of the projection is to build the bolt and projection so that the two elements separate and rejoin by screwing the projection out of/into the bolt. The "U" shape of the barrier 64' makes is more suitable for a sliding bolt latch that may be used for doors swinging open in either direction, because a longer straight segment portion of a "J" shape barrier does not allow bolt rotation in one of the two directions. A reason to change the position of the projection is to be able to install the sliding bolt latch so that the handle of the bolt stays pointing down due to gravity when a user is not momentarily rotating the bolt to lock or to unlock the door. Thus, the bolt handle is less likely to snag people, livestock, etc. passing near the door.

The present embodiment may also be embodied as a method of using a sliding bolt latch assembly. Such embodiment is described with reference to FIGS. 4A-4E depicting use of the sliding bolt latch assembly 38 of FIGS. 3A-3C.

Figure 4A:
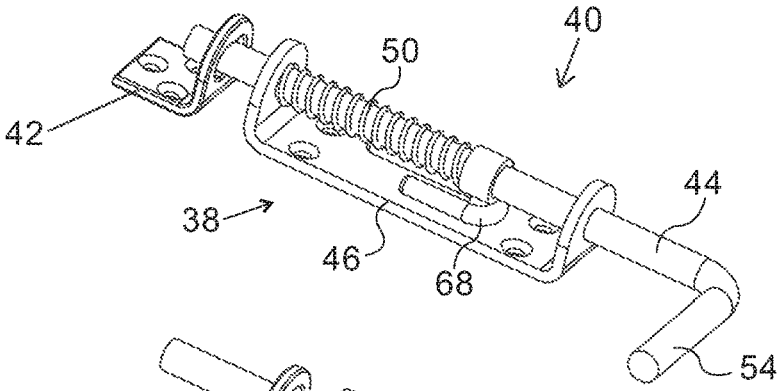
FIGS. 4A-4E illustrate various positions of the bolt of FIGS. 3A-3C relative to the base and the brace of the same figures.

In FIG. 4A, the sliding bolt latch assembly 38 is in the "locked" position. The brace 42 may be affixed to a door frame while the sliding bolt latch 40 is affixed to a door. (In alternative embodiments, the brace 42 may be affixed to the door frame while the sliding bolt latch 40 is affixed to the door.) The spring 50 biases the bolt 44 so that the projection 52 (not visible in FIG. 4A) extending transversely therefrom contacts the curved portion 68 of the barrier 64.

Figure 4B:
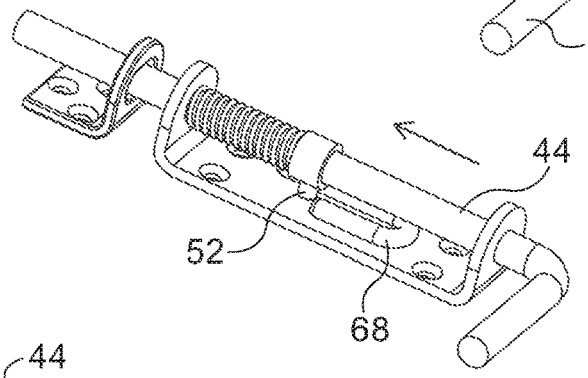

To transition the sliding bolt latch assembly 38 to the "unlocked" position, the bolt 44 is forced against the biasing force of the spring 50 along the bolt axis toward the brace 42. This force may be applied by the user pushing the handle 54. As illustrated in FIG. 4B, when the bolt 44 slides in the direction of the arrow, the projection 52 from the bolt 44 moves away from the curved portion 68 of the barrier 64.

Figure 4C:
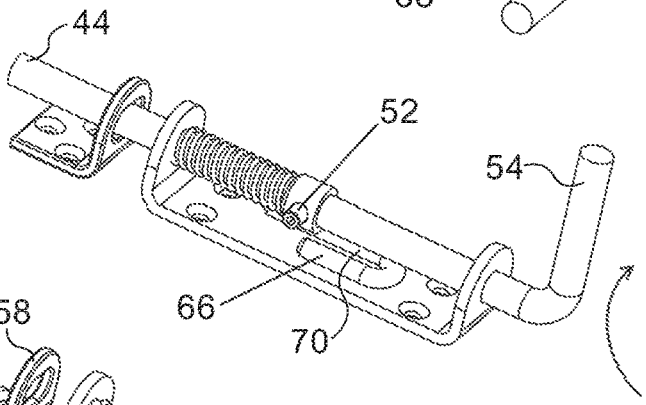

As shown in FIG. 4C, the bolt 44 eventually slides far enough so that the projection 52 is no longer confined between the straight portions 66, 70 of the barrier 64. Accordingly, the bolt 44 is rotated in the direction which rotation is not constrained. This rotation may be effected by the user rotating the handle 54. The non-constrained rotation moves the projection 52 away from the longer straight portion 70 to an area beyond which the shorter straight portion 66 no longer extends. Accordingly, the "J" shape of the barrier 64 allows rotation of the bolt 44 in only one direction.

Figure 4D:
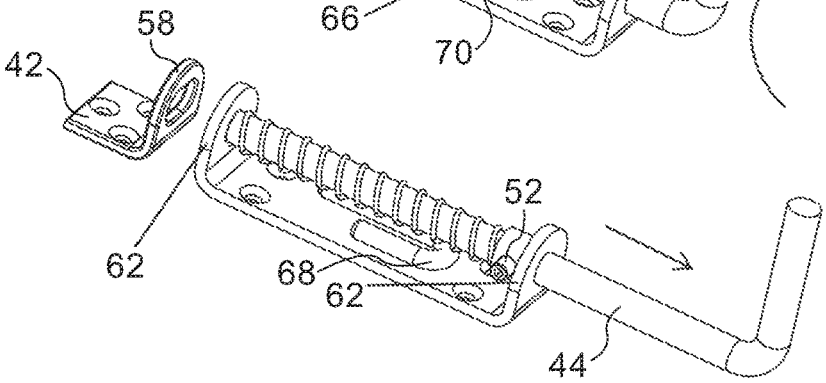

The user then allows the bolt 44 to slide back in the direction of the spring biasing force, as shown by the arrow in FIG. 4D. As the projection 52 is no longer in the position to have its translational movement blocked by the curved portion 68 of the barrier 64, the bolt 44 may slide further away from the brace 42 until the bolt 44 is no longer surrounded by the bolt guide 58 of the brace 42. The sliding bolt latch assembly 38 is now in the "unlocked" position, and the door upon which the sliding bolt latch 40 is mounted is free to open. In some implementations of the present embodiment, the length of the bolt 44 is set so that, when the sliding bolt latch assembly 38 is in the unlocked position, that is, when the bolt 44 has slid its maximum distance in the direction of the biasing of the spring 50, the end of the bolt 44 is flush with a bolt guide 62 of the base 46 as shown in FIG. 4D, and accordingly the bolt 44 will not snag clothes, users, livestock, or other objects passing by the door closely.

Figure 4E:
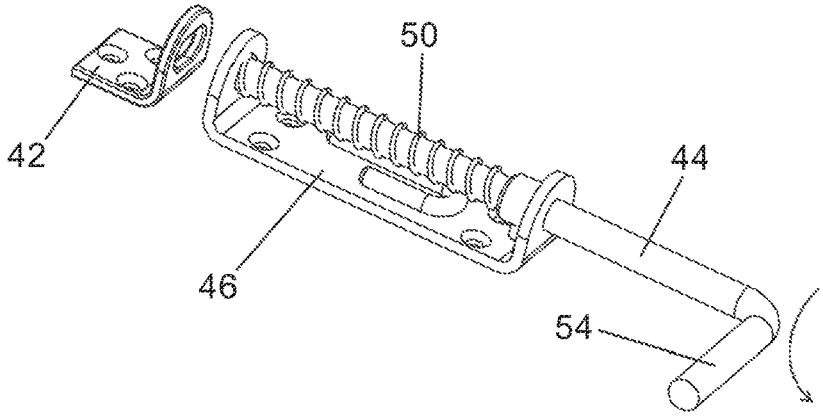

The handle 54 may be rotated to the position illustrated in FIG. 4E so that there is less of a general protrusion of the sliding bolt latch assembly 38 that may snag clothes, users, livestock, or other objects likely to pass close to the door. By mounting the sliding bolt latch assembly 38 so that the handle 54 as shown in FIG. 4E is pointing down, if enough friction of rotational bolt movement is reduced, the handle 54 naturally points down by virtue of gravity. Accordingly, vibrations are less likely to cause the sliding bolt latch assembly 38 to open undesirably. Even without the reduced friction, though, the sliding bolt latch assembly 38 is less likely to open due to ambient vibrations because of the spring 50 forcing the projection 52 of the bolt 44 against the barrier 64.

If the present method is executed upon a sliding bolt latch assembly that has a barrier such as the barrier 64' in FIG. 3D, that is, in which the straight portions were of equal length, the bolt could be rotated in either direction to allow it to be slid in the direction to unlock the sliding bolt latch assembly. The handle needs to have no impediment to its corresponding rotations; for example, a recess may be formed in the surface upon which the base of the sliding bolt latch is mounted.

Figure 5A:
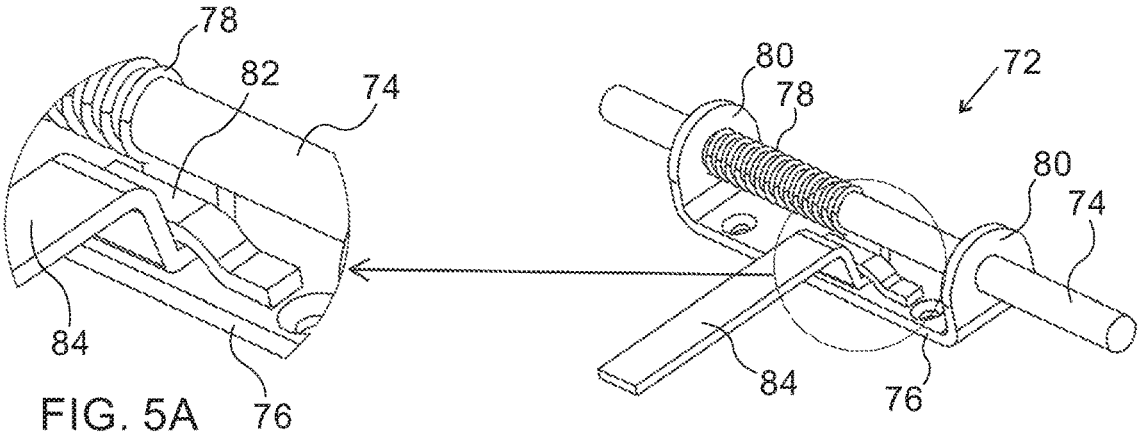
FIGS. 5A-5D present a sliding bolt latch assembly in accordance with another embodiment of the invention.
Figure 5B:
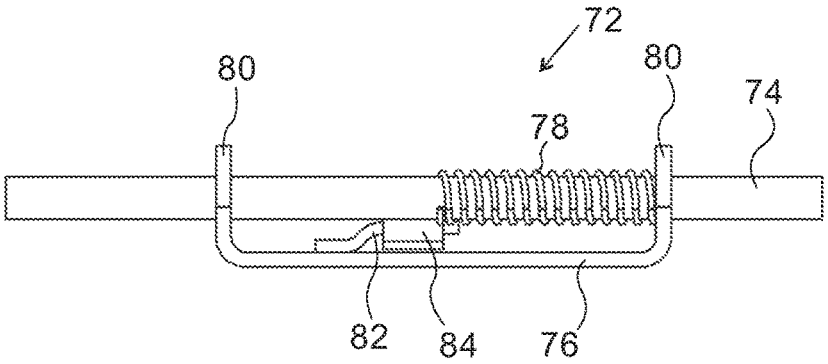
Figure 5C:
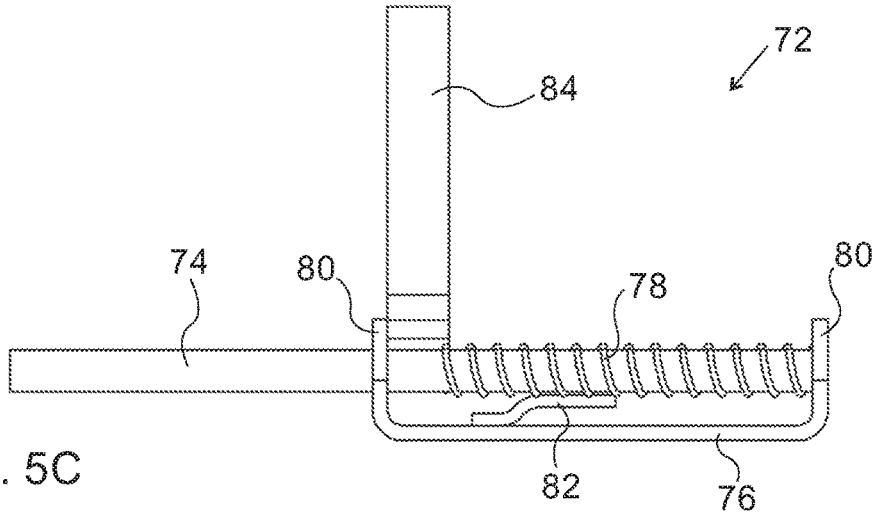
Figure 5D:
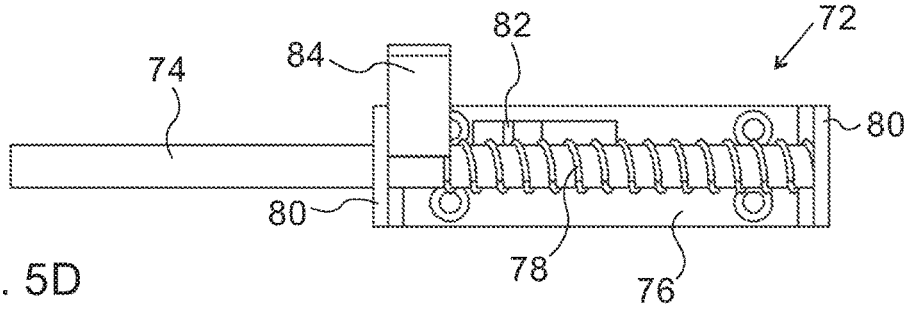

Another exemplary embodiment of the invention, also a sliding bolt latch assembly, is illustrated in FIGS. 5A-5D. FIGS. 5A and 5B provide perspective and rear views, respectively, of the sliding bolt latch 72 of the sliding bolt latch assembly when in the "locked" state. In the view of FIG. 5A, a corresponding brace (not shown in the figures for clarity) is positioned to the upper left of the sliding bolt latch 72, and in the view of FIG. 5B, the brace is positioned to the right of the sliding bolt latch 72. FIGS. 5C and 5D show rear and top views, respectively, of the sliding bolt latch 72 when in the "unlocked" state. In both the views of FIGS. 5C and 5D, the brace is positioned to the right of the sliding bolt latch 72.

As with the first embodiment, the sliding bolt latch 72 of this embodiment includes a bolt 74, a base 76, a spring 78, two bolt guides 80, and a barrier 82. Unlike the first embodiment, though, the sliding bolt latch 72 has a single element 84 that is both the handle and the projection that the barrier 82 limits the movement thereof.

The method of the using the sliding bolt latch 72 of this embodiment is discussed with reference to FIGS. 6A-6E. As with FIGS. 5A-5D, the corresponding brace of this embodiment of the sliding bolt latch assembly is not illustrated for clarity. In FIGS. 6A-6E, the brace's position is to the upper left of the sliding bolt latch 72, as it is in FIG. 5A.

Figure 6A:
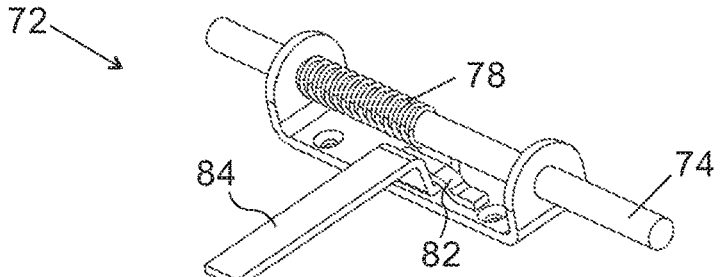
FIGS. 6A-6E illustrate various positions of the bolt and handle/projection of FIGS. 5A-5D relative to the base and barrier of the same figures.
Figure 6B:
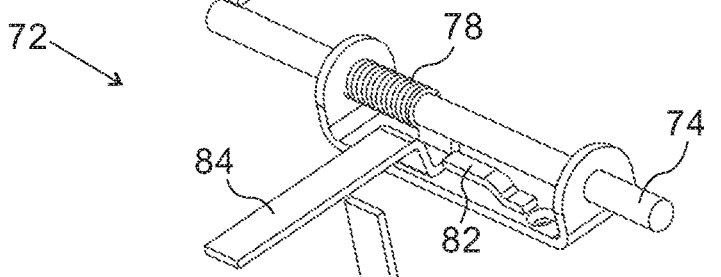

In FIG. 6A, the sliding bolt latch 72 is in the "locked" position, and the spring 78 biases the bolt 74 so that the handle 84 is pressed against the barrier 82. Accordingly, the handle 84 and bolt 74 cannot be rotated.

To transition the sliding bolt latch 72 to the "unlocked" position, the bolt 74 is forced against the biasing force of the spring 78 along the bolt axis toward the brace. As illustrated in FIG. 8B, when the bolt 74 slides, the handle 84 moves away from the barrier 82.

Figure 6C:
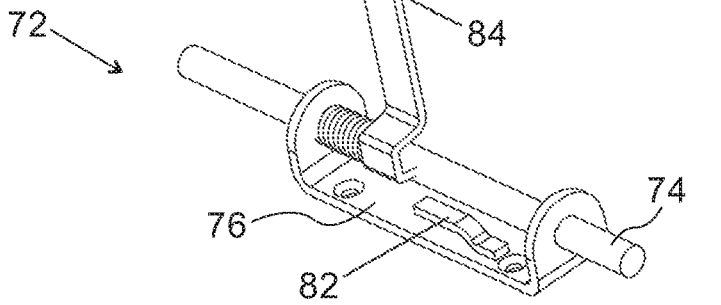

As shown in FIG. 6C, the bolt 74 eventually slides far enough so that the handle 84 is no longer prevented from rotational movement by the barrier 82. The user accordingly rotates the handle 84 in the direction not constrained by the base 76.

Figure 6D:
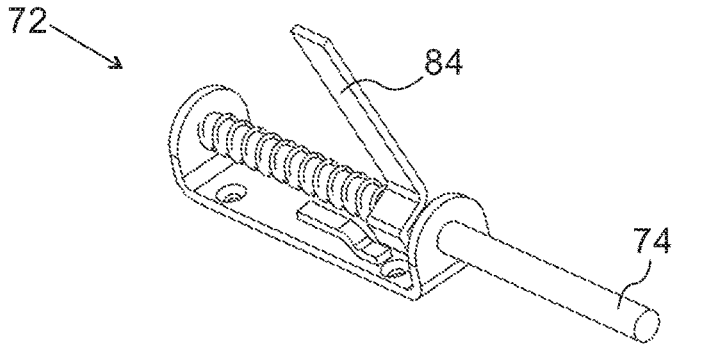

The user allows the bolt 74 to slide back in the direction of the spring biasing force as shown in FIG. 6D. The bolt 74 slides far enough away from the brace until the bolt 74 is no longer surrounded by the bolt guide of the associated brace of the sliding bolt latch assembly. The sliding bolt latch 72 is now in the "unlocked" position, and the door upon which the sliding bolt latch 72 is mounted is free to open.

Figure 6E:
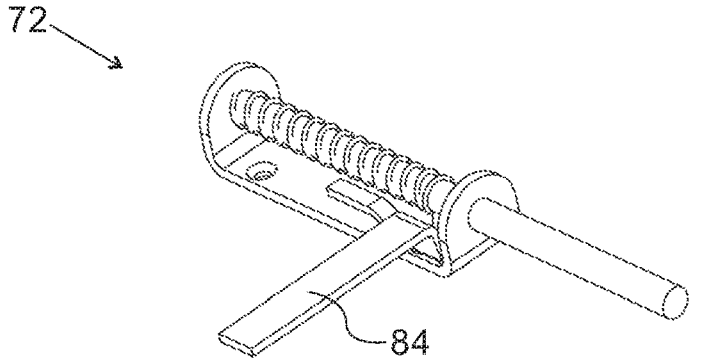

The handle 84 may be rotated to the position illustrated in FIG. 6E so that there is less of a general protrusion of the sliding bolt latch 72 from the plane of the door.

Figure 7:
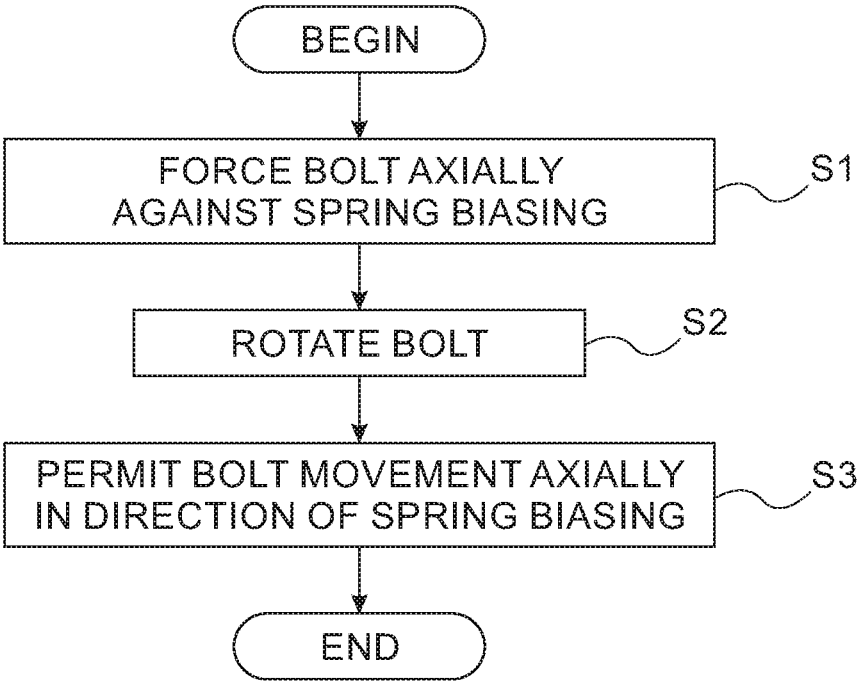
FIG. 7 provides a flowchart describing a method of unlocking a latch assembly, such as any of those shown in previous figures, in accordance with still another embodiment of the invention.

Still another exemplary embodiment of the invention is a method of unlocking a latch assembly, and the method is described with reference to the flowchart in FIG. 7. The method may be executed on any of the latch assemblies described above. In particular, the latch assembly upon which the method is performed has a bolt and a spring biasing the bolt to an axial position in which the bolt cannot rotate. In any case, the embodiment is not limited to use on only the latch assemblies described above.

The method begins by forcing the bolt to move axially against the spring biasing. (Step 1.) For latch assemblies manufactured with strong spring biasing, if a handle is formed integral with the bolt, a user of the latch assembly may find it helpful to position the heel of his/her hand on the handle and position his/her fingertips on a base of the latch assembly to move the bolt by a squeezing motion of the hand. Alternatively, the user may want to grasp the handle and lean against the biasing force.

As discussed above, the bolt initially cannot rotate. However, the present latch assemblies allow bolt rotation after the bolt moves a sufficient distance axially against the spring biasing. Accordingly, the next step of the present method is to rotate the bolt. (Step 2.) If the user of user of the latch assembly discontinued forcing the bolt axially against the spring biasing without rotating the bolt, the bolt would return to its original position and the latch assembly would remain locked.

The bolts of the latch assemblies upon which the present method is practiced are initially constrained from moving axially with the spring biasing pass a certain point, due to the positioning of a barrier of some sort. However, after the bolt rotation of Step 2, the barrier no longer constrains this axial motion. Accordingly, the next step of the present method is to permit the bolt to move axially in the direction of the spring biasing (Step 3), and spring moves the bolt further axially than its original position. Eventually, the bolt is no longer surrounded by a bolt guide of a brace of the latch assembly, and the latch assembly is now unlocked. The method is concluded.

Accordingly, embodiments of the invention are convenient as in the prior art, as a user may open and close a door with only one hand. However, the embodiments are more reliable for locking doors, because of multiple factors. For example, the spring biasing the bolt into locking state makes the sliding bolt latch assembly less likely to fail in the presence of ambient vibrations. Also, the requirement for both rotational and translational movements of the bolt against a biasing force make opening the sliding bolt latch assembly much more difficult for livestock to maneuver the components of the sliding bolt latch assembly. It may be desired to use a strong spring so that one-handed opening requires squeezing while the heel of the hand is positioned on the handle and the fingertips are on the base. In any case, the spring improves the reliability of the sliding bolt latch assembly by returning the bolt to the locked position, if the proper sequence of translational and rotational movements to unlock the sliding bolt latch assembly is not completed.

Having thus described exemplary embodiments of the invention, it will be apparent that various alterations, modifications, and improvements will readily occur to those skilled in the art. Alternations, modifications, and improvements of the disclosed invention, though not expressly described above, are nonetheless intended and implied to be within spirit and scope of the invention. For example, instead of a coil spring surrounding the bolt and biasing it in one direction as in embodiments described above, other types of biasing mechanisms are implemented. As another example, embodiments of the invention are made also with a spring biasing the bolt rotationally, such as to position the handle in a particular direction without relying on gravity. Accordingly, the foregoing discussion is intended to be illustrative only; the invention is limited and defined only by the following claims and equivalents thereto.

I claim:

1. A sliding bolt latch, comprising:

a slidable bolt extending along a bolt axis and rotatable thereabout;

a biasing member for biasing the slidable bolt along the bolt axis;

a projection extending from the slidable bolt; and a base including:

a first bolt guide;

a second bolt guide spaced away from the first bolt guide along the bolt axis; and a barrier spaced away from the first and second bolt guides along the bolt axis, said barrier including an open end facing said first bolt guide, a closed end opposite to and spaced away from said open end along the bolt axis, and at least one wall extending between the open end and the closed end, wherein said barrier is configured for being selectively engaged by the projection at a first distance from the first bolt guide, for simultaneously limiting rotational movement of the projection about said bolt axis and sliding movement of the projection along said bolt axis in a direction away from the first bolt guide;

wherein said slidable bolt is displaceable between:

a locked position, in which said projection is engaged with the closed end of the barrier at said first distance from the first bolt guide, and the closed end and the at least one wall simultaneously limit the sliding movement of the projection along said bolt axis in the direction away from the first bolt guide and the rotational movement of the projection about said bolt axis, respectively, and an unlocked position, in which said projection is disengaged from said barrier and is disposed at a second distance from said first bolt guide, which is greater than said first distance;

wherein said slidable bolt is displaceable between said locked position and unlocked position is displaceable initially in a direction towards said first bolt guide and subsequently in the direction away from said first bolt guide.

2. The sliding bolt latch according to claim 1, wherein said slidable bolt is further displaceable through a transition position between said locked position and said unlocked position, in which said projection is disengaged from said barrier, and in which said projection is disposed at any third distance from said bolt guide, which is shorter than said first distance.

3. The sliding bolt latch according to claim 2, wherein in said transition position, the projection is free for rotation about said bolt axis at an angle which is equal to or smaller than in said unlocked position.

4. The sliding bolt latch according to claim 2, wherein at said transition position, said projection is rotatable with respect to said barrier by an angle of at least 180 degrees.

5. The sliding bolt latch of claim 1, wherein in said unlocked position, said projection is rotatable with respect to said base by an angle of at least 180 degrees.

6. The sliding bolt latch of claim 5, wherein in said unlocked position, said projection is rotatable with respect to said base by an angle of 360 degrees.

7. The sliding bolt latch of claim 1, wherein said biasing member is disposed between said first bolt guide and said projection.

8. The sliding bolt latch of claim 1, further comprising a handle integral with the slidable bolt.

9. The sliding bolt latch of claim 8, wherein said handle has a handle axis extending therealong, and the handle axis is angled with respect to the bolt axis.

10. The sliding bolt latch of claim 1, wherein said biasing member includes a spring.

11. The sliding bolt latch of claim 10, wherein said spring includes a compression spring.

12. A sliding bolt latch assembly comprising:

the sliding bolt latch of claim 1; and a brace for constraining translational movement of the slidable bolt to the bolt axis when the slidable bolt is in one region of axial positions and for allowing translational movement of the slidable bolt in addition to axial movement when the slidable bolt is in another region of axial positions.

13. The sliding bolt latch according to claim 1, wherein a distance between the closed end and the open end is no less than a dimension of the projection parallel to said bolt axis.

14. The sliding bolt latch according to claim 1, wherein at said unlocked position of said slidable bolt, said projection engages with said second bolt guide.

15. A sliding bolt latch, comprising:

a slidable bolt extending along a bolt axis and rotatable thereabout;

a biasing member for biasing the slidable bolt along the bolt axis;

a projection extending from the slidable bolt; and a base including:

a first bolt guide with a first side facing the projection and an opposite second side;

a second bolt guide spaced away from the first bolt guide along the bolt axis; and a barrier spaced away from the first and second bolt guides along the bolt axis, said barrier including an open end facing said first bolt guide, a closed end opposite to and spaced away from said open end along the bolt axis, and at least one wall extending between the open end and the closed end, wherein said barrier is configured for being selectively engaged by the projection for simultaneously limiting rotational movement of the projection about said bolt axis and sliding movement of the projection along said bolt axis in a direction away from the first bolt guide;

wherein said slidable bolt is displaceable between:

a locked position, in which said projection is engaged with the closed end of the barrier, the closed end and the at least one wall simultaneously limit the sliding movement of the projection along said bolt axis in the direction away from the first bolt guide and the rotational movement of the projection about said bolt axis, respectively, and an end of the slidable bolt extends from said second side of the first bolt guide to a first extent from the second side, and an unlocked position, in which said projection is disengaged from said barrier and the end of the slidable bolt extends from the second side to a second extent, which is shorter than said first extent;

wherein said slidable bolt is displaceable between said locked position and unlocked position is displaceable initially in a direction towards said first bolt guide and subsequently in the direction away from said first bolt guide.

16. The sliding bolt latch according to claim 15, wherein said slidable bolt is further displaceable through a transition position between said locked position and said unlocked position, in which said projection is disengaged from said barrier, and in which the end of the slidable bolt extends from the second side to a third extent, which is greater than said first extent.

17. The sliding bolt latch of claim 15, further comprising a handle integral with the slidable bolt.

18. The sliding bolt latch of claim 17, wherein said handle has a handle axis extending therealong, and the handle axis is angled with respect to the bolt axis.

19. The sliding bolt latch of claim 15, wherein said biasing member is disposed between said first bolt guide and said projection.

20. A method for operating a sliding bolt latch comprising: a slidable bolt extending along a bolt axis and rotatable thereabout; a spring biasing the slidable bolt along the bolt axis; a projection extending from the slidable bolt; and a base having a first bolt guide, a second bolt guide spaced away from the first bolt guide along the bolt axis, and a barrier disposed between the first bolt guide and the second bolt guide along the bolt axis, said barrier having an open end facing said bolt guide, a closed end opposite to and spaced away from said open end along the bolt axis, and at least one wall extending between the open end and the closed end, wherein said barrier is configured for being selectively engaged by the projection at a first distance from the first bolt guide, for simultaneously limiting rotational movement of the projection about said bolt axis and sliding movement of the projection along said bolt axis in a direction away from the first bolt guide; said method comprising:

positioning said slidable bolt at a locked position, in which said projection is engaged with the closed end of the barrier at a first distance from the first bolt guide and the closed end and the at least one wall simultaneously limit the sliding movement of the projection along said bolt axis in the direction away from the first bolt guide and the rotational movement of the projection about said bolt axis, respectively; and displacing said slidable bolt from said locked position to an unlocked position, in which said projection is disengaged from said barrier and is disposed at a second distance from said first bolt guide, which is greater than said first distance;

wherein displacing said slidable bolt between said locked position and unlocked position comprises displacing said slidable bolt initially in a direction towards said first bolt guide and subsequently in the direction away from said first bolt guide.

21. The method of claim 20, wherein said displacing said slidable bolt from said locked position to said unlocked position includes:

sliding said slidable bolt along said bolt axis toward said first bolt guide so as to position said projection at a third distance from said first bolt guide, which is shorter than said first distance, and in which said projection is disengaged from said barrier, thereby causing said slidable bolt to assume a transition position;

rotating said slidable bolt about said bolt axis; and sliding said slidable bolt in a direction away from said first bolt guide.

22. The method of claim 20, wherein said sliding of said slidable bolt along said bolt axis toward said first bolt guide is performed against a biasing force of said spring.

* * * * *